United States Patent [19]

Guo et al.

[11] Patent Number: 4,834,075

[45] Date of Patent: May 30, 1989

[54] ELECTROMECHANICAL MASSAGE APPARATUS

[76] Inventors: Yuh-Kuen Guo; Feng-Mei Song, both of No. 16, Min-Le Rd., Pei-Kang Chen, Yun-Lin Hsien, Taiwan

[21] Appl. No.: 217,936

[22] Filed: Jul. 12, 1988

[51] Int. Cl.[4] ..... A61H 23/02

[52] U.S. Cl. ..... 128/49; 128/48

[58] Field of Search ..... 128/51, 52, 55, 56, 128/59, 57, 60, 33, 44, 62 R, 67, 46, 49, 25 B, 48

[56] References Cited

U.S. PATENT DOCUMENTS

| | | | |
|---|---|---|---|
| 1,375,652 | 4/1921 | Carlotti | 128/51 |
| 2,002,586 | 5/1935 | Ryberg | 128/25 B |
| 2,128,790 | 8/1938 | Barbour | 128/52 |
| 2,513,197 | 6/1950 | Moshier | 128/25 B |
| 2,869,158 | 1/1959 | Sivells | 128/51 |
| 3,504,665 | 4/1970 | Bakunin et al. | 128/52 |
| 3,511,229 | 5/1970 | Romo | 128/52 |
| 3,548,811 | 12/1970 | Wilson | 128/25 B |
| 3,640,272 | 2/1972 | Hussey | 128/33 |

*Primary Examiner*—Paul T. Sewell
*Assistant Examiner*—Huong Q. Pham
*Attorney, Agent, or Firm*—Berman, Aisenberg & Platt

[57] ABSTRACT

An electromechanical massage apparatus including a massage body structure and a detachable supporting mount wherein the massage body structure includes a housing unit adapted to be positioned on a place adjacent to the detachable supporting mount and provided with a speed regulator, a switch and a timer on a front side of the housing unit. Elements installed in the housing unit include: a motor having a swivel disk fixed on the motor shaft and electrically coupled with the switch, the speed regulator and the timer; a linking mechanism matched with a push pole arrangement movably connected to the swivel disk; and a massage device detachably mounted on a free end of the push pole arrangement for performing massage operations. The detachable supporting mount includes: a base stand; a shaft matched with a shaft sleeve vertically installed at a middle portion of the base stand; a supporting plate fixed around the shaft sleeve; and a plurality of partitioning boards with different binding straps vertically disposed on top of the supporting place for supporting a portion of a human body so as to perform massage operations.

6 Claims, 7 Drawing Sheets

ELECTROMECHANICAL MASSAGE APPARATUS

BACKGROUND OF THE INVENTION

This invention relates to a massage apparatus, and more particularly to a type of electromechanical massage apparatus by which various massage modes can be conveniently applied to all parts of a human body regardless of body positions.

Massage has long been regarded as an effective method for physical treatment, particularly for treating some chronic ailments. at present two types of electrical massage apparatus are available on the market, one of which is of a vibrating type, and the other of a stroking type.

The known vibrating type of massage apparatus is gnerally constructed in a form of a flat table or a chair on which human body limbs are laid or rested for receiving the massage operations on certain body areas. This 'areal' treatment of vibration on a human body can hardly achieve remedial effect, particularly on a specific area of the body, such as a vital vein part, where localized massage is required. In addition, the known hand-operated vibrating type massage apparatus can be used for the localized massage; howevever, not only is the operation thereof inconvenient for the user, (because it has to be held in one hand by the user him/herself in performing the massage or the aid of another person must be sought), but the treatment made with it is also ineffective.

The known stroking type of massage apparatus can be used for performing localized spot massage operation, but its monotonous stroking operation is not satisfactory for providing the selected massage mode in meeting alternative treatment requirements.

SUMMARY OF THE INVENTION

It is accordingly a primary object of the present invention to provide an electromechanical massage apparatus with a fixed driving mechanism operatively connected to a kneading member which is designed to produce reciprocating motion with repeated level or curve movements for the purpose of performing different massage operations.

It is another object of the present invention to provide an electromechanical massage apparatus with a detachable mount of which the height and inclination can be optionally adjusted so as to be adatable to the positioning and binding of limbs and portions of a body for retaining comfortable massage operations.

These and other objects of the present invention are achieved by the provision of an electromechanical massage apparatus which comprises, in combination, a massage body structure and a supporting mount. The massage body structure includes: a housing unit; a speed reducing motor having a swivel plate fixed on its output shaft, installed in the housing unit; a revolving rod radially installed on the swivel plate; a driving rod pivotally connected to the revolving rod at one end and fixedly fastened to a push rod at the other end; a spindle sleeve arranged at a middle portion of the driving rod; and a massage member detachably arranged at the free end of the push rod. The supporting mount includes: a base stand having a shaft vertically installed in a middle portion; a supporting plate adjustably mounted over the base stand around the shaft; and a plurality of partitioning plates with various binding straps fixed in upright angular patterns on the supporting plate; thereby, a user can set any member of his/her limbs or a specific area of his/her body on the supporting mount, exposing it to the massage body structure for performing massage operations.

The advantages and characteristics of the present invention will become apparent from the following detailed description of a preferred embodiment when read in conjunction with the accompanying drawings.

DETAILED DESCRIPTION OF THE PREFERRED EMBODIMENT

Figure 2:
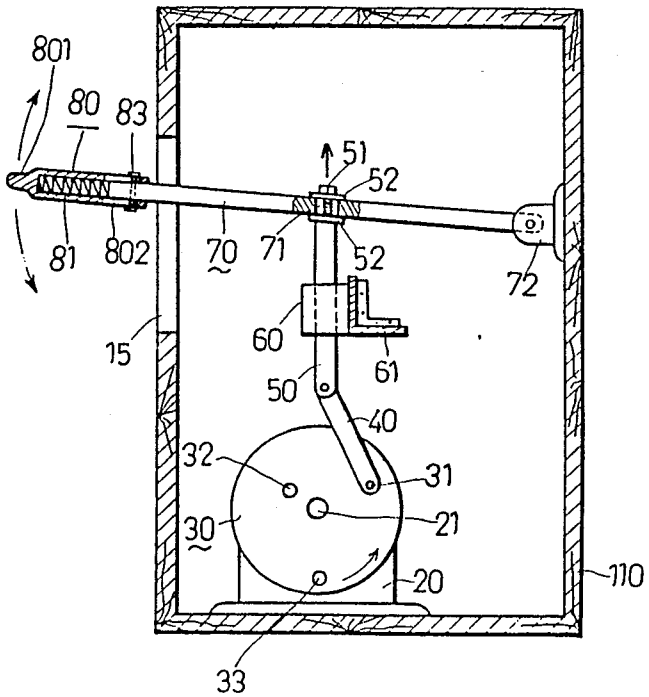
FIG. 2 is a partial sectional view of the massage body structure indicating a schematic inner arrangement thereof.

Referring to FIGS. 1, 2, 5 and 6, the preferred embodiment of an electromechanical massage apparatus according to the present invention comprises a massage body structure 10 and a detachable supporting mount 100. The massage body structure 10 includes a rectangular housing unit 110 adapted for being positioned either horizontally or vertically on a place close to the supporting mount 100 with a handle ring 14 fixed on its top side surface, a speed regulator 11, a switch 12, a timer 13 and an elongated slot 15 separately provided on its front side surface, and a door (not shown) on its back side. (It is to be noted that since the structure and arrangement of the speed regulator 11, the switch 12 and the timer 13 are well known to those skilled in the art, detailed description is therefore omitted for purpose of clarity.)

Elements installed in the housing unit 110 include: a speed reduction motor 20 installed on a bottom side and functionally connected to the speed regulator 11 for effecting speed adjustment; a swivel disk 30 having a plurality of pin holes 31, 32, 33 provided at different locations away from the center point thereof connected to the motor shaft 21; a linking mechanism composed of a revolving rod 40 and a driven rod 50 wherein the lower end of the revolving rod 40 is movably connected to the swivel disk 30 through pin holes 31 and the upper end of the revolving rod 40 is pivotally linked with the lower end of the driven rod 50; a spindle sleeve 60 movably enclosing a portin of the driven rod 50 and fixed on the opposing sides of the housing unit 110 through an angle-iron rack 61; a push pole 70 with its rear end pivotally installed on an inner side surface of the housing unit 110 through a pivotal joint 72, its middle portion fixed on a threaded top end of the driven rod 50 through a nut 51 and washers 52, and its front end extending out of the elongated slot 15 of the housing unit 110; and a massage member 80 formed with a front end 801 for kneading purpose and a cylindrical body portion 802 coupled with a resilient element 81 in the open section thereof enclosed around the front portion of the push pole 70 and detachably secred thereto with a screw bolt 83. With the arrangement of the above described elements, when the motor 20 is started, the swivel disk 30 will be rotatably moved along with the motor shaft to drive the revolving rod 40 and the driven rod 50 so as to operate the massage member 80 to move up and down in performing the required massage operations. (It shall be appreciated that an electrical heating element may be arranged at the front end of the massage member 80 so as to achieve a thermomassage effect.) The housing unit 110 can also be horizontally positioned to perform horizontal-movement massage operations if required. (It shall be appreciated that the front end of the massage member 80 matched with the resilient member 81 can automatically produce kneading effect on a portion of the user's body abutting upon the front end of the massage member 80.)

Figure 3:
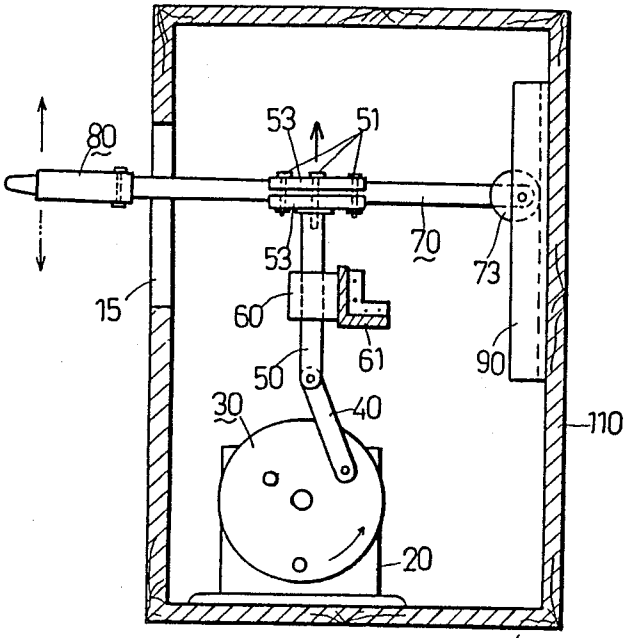
FIG. 3 is a partial sectional view of the massage body structure showing an alternative arrangement of a push pole according to this invention.

Referring to FIG. 3, there is shown an alternative example of the arrangement of push pole 70 whose rear end is provided with a roller bearing 73 movably installed in a slide track 90. In addition, the top end of the driven rod 50 is connected to push pole 70 through a plurality of screw bolts 51 and washer 53. (It shall be appreciated that the top end of the driven rod 50 can be connected to the push pole 70 through a welding process.) Consequently, when the motor 20 is started, the swivel disk 30 will be rotated to drive the push pole 70 to move up and down along the slide track 90 so as to effect massage operations against a portion of the user's body exposed to the massage member 80.

Figure 4:
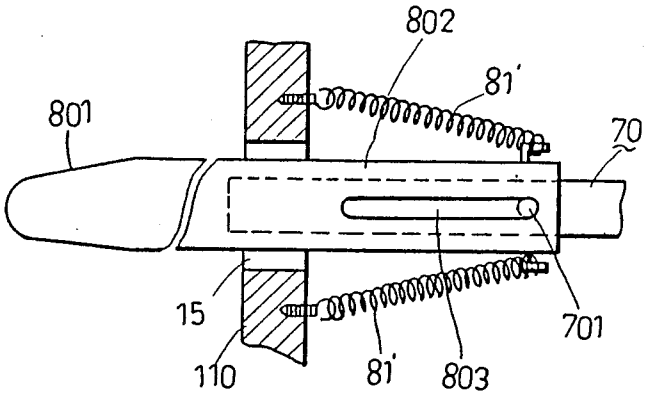
FIG. 4 is a schematic illustrative view of an alternative embodiment of a massage member detachably secured at a front end of the push pole according to this invention.

Referring to FIG. 4, there is shown an alternative example of the massage member 80 which includes a through sliding slot 803, formed in opposing sides of the cylindrical body portion 802 (one side is hidden) for being movably engaged with a stop pin 701 which is provided and extends in opposite directions at the front portion of the push pole 70, and a pair of resilient elements 81' of which the rear ends are symmetrically fastened at the rear opposing sides of the cylindrical body portin 802 and the front ends, as shown in the drawing, are separately fixed on the inner side wall of the housing unit and positioned over the upper and lower locations of the elongated slot 15. Therefore, when the front end 801 of the massage member 80 is pressed against a portion of the user's body during massage, the cylindrical body portion 802 will be moved backward along the front portion of the push pole 70 through the sliding slot 803 so that when the pressure applied on the massage member 80 is reduced or released, the resilient elements 81' will pull the cylindrical body portion 802 forward until the rear end of the sliding slot 803 is impinged upon the stop pin 701 at both sides of the push pole 70 and reciprocating kneading operations are hereby achieved.

Figure 5:
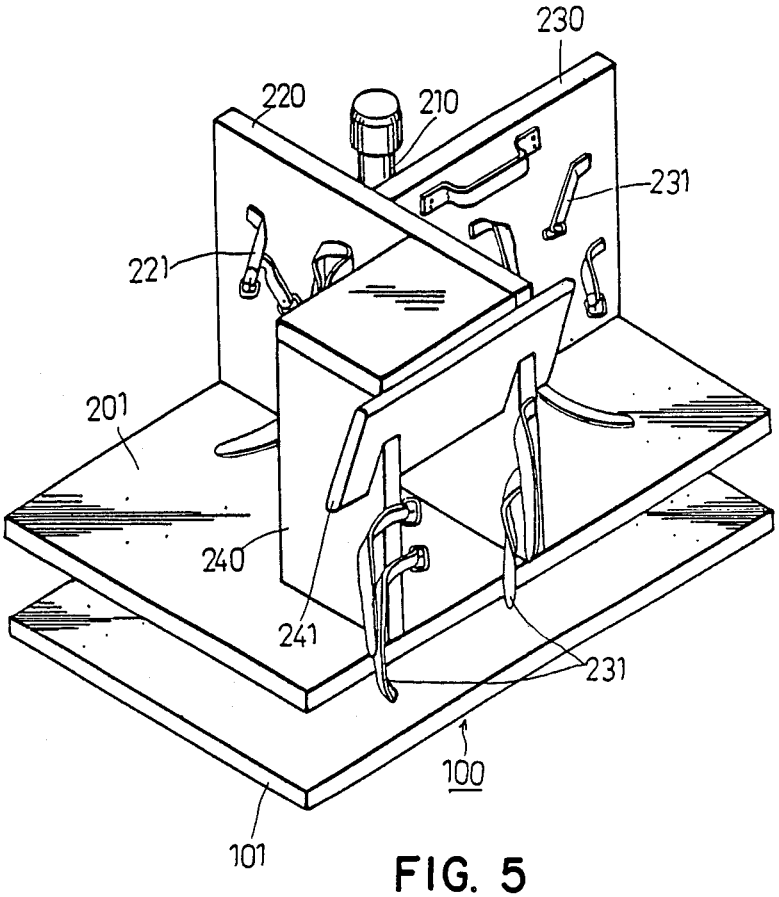
FIG. 5 is a perspective view of a supporting mount embodied in the electromechanical massage apparatus according to this invention.
Figure 6:
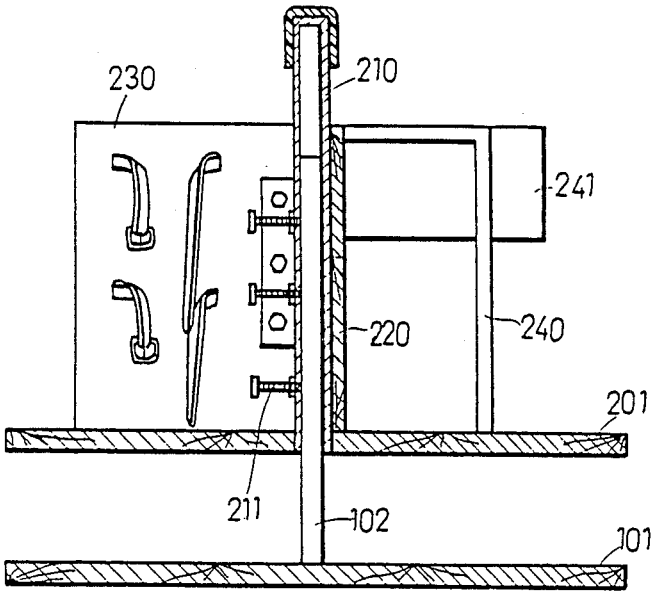
FIG. 6 is a partial side sectional view of the supporting mount shown in FIG. 5.
Figure 7:
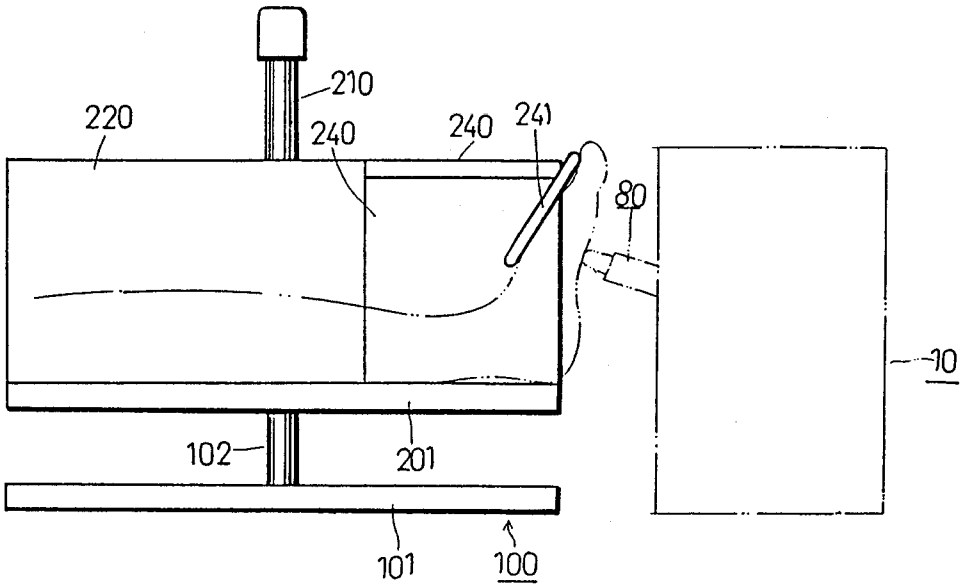
FIG. 7 is a schematic illustrative view of the preferred embodiment showing a massage operation being performed on a user's foot sole.

Referring to FIGS. 5, 6 and 7, the preferred embodiment of the detachable supporting mount 100 according to this invention comprises: a base stand 101 adapted for being positioned on a ground surface; a mounting shaft 102 with a plurality of threaded holes (not shown) vertically installed on a middle portion of the base stand 101; a shaft sleeve 210 having a plurality of screw openings, corresponding to the threaded holes of the mounting shaft, vertically formed therein enclosing the mounting shaft 102 and adjustably secured thereto with a plurality of screw bolts 211; a supporting plate 201 fixed around the lower end of the shaft sleeve 210 for being adjusted up and down along with the shaft sleeve 210; a plurality of partitioning boards 220, 230 vertically positioned on the supporting plate 201 defining different angled spaces therein; a plurality of binding straps 221, 231 attached to the proper places of the partitioning boards 220, 230 for binding a certain part of a user's limbs during massage; an inverse L-shaped frame 240 vertically positioned against the partitioning board 220 forming an open section therein; and an oblique plate with a pair of notches at one side separately engaged with the inverse L-shaped frame 240 and the partitioning board 220 so as to form a slant face thereat for being used to keep a user's foot in position during massage, as shown in FIG. 7. (It shall be appreciated that if another part of the user's body portion is to be massaged, he/she can select different partitioning boards 220, 230 as his/her body support and adjust the height of the support plate 201 for performing the required massage operation on the detachable supporting mount 100.) In addition, the massage body structure 10 can be optionally positioned at a place close to the supporting mount 100 according to the positioning of a user's limbs or body, in preparation for performing the massage operations.

Figure 8A:
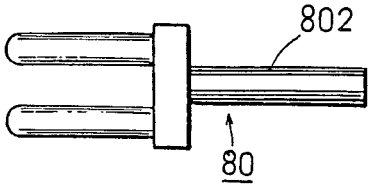
FIG. 8(A) is a plan illustration of a double-arm massage member adaptable for the massage body structure.
Figure 8B:
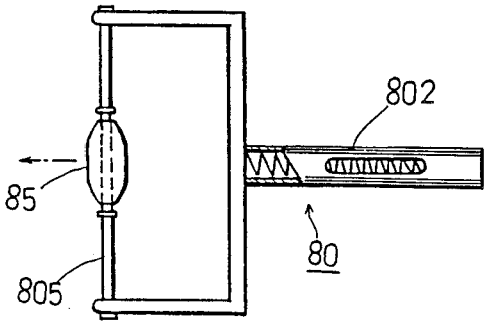
FIG. 8(B) is a schematic illustration of a vertical bow-type massage member adaptable for the massage body structure.
Figure 8C:
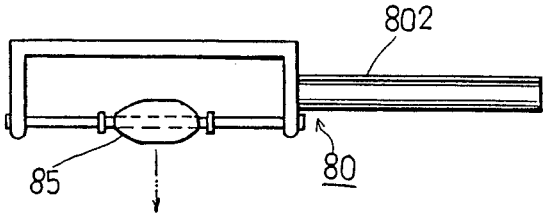
FIG. 8(C) is a schematic illustration of a horizontal bow-type massage member adaptable for the massage body structure.

Referring to FIGS. 8(A), 8(B) and (C), in order to enable the massage member 80 to be adaptable to all kinds of massage operations in conjunction with the human body structure, a double-arm structure as shown in FIG. 8(A), a vertical bow-type structure having a massage ball 85 detachably disposed at a middle portion of its cross brace 805 as shown in FIG. 8(B) and a horizonal bow-type structure as shown in FIG. 8(C), can be alternatively made available for meeting a user's requirements of replacement.

Figure 9A:
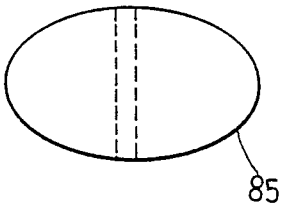
FIG. 9 (A, B, C) are representations of various roll followers adaptable for the bow-type massage members shown in FIGS. 8(B) and 8(C).
Figure 9B:
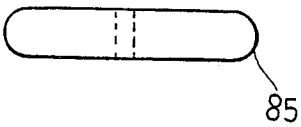
Figure 9C:
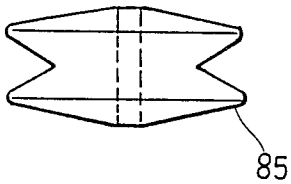

Referring to FIGS. 9)A), 9(B) and 9(C), in order to make the massage ball 85 more suitable for massaging various portions of the human body and limb structure, different shapes such as the "oval" in FIG. 9(A), the "roller" in FIG. 9(B) and the "dented sphere" in FIG. 9(C) are made available.

Figure 1:
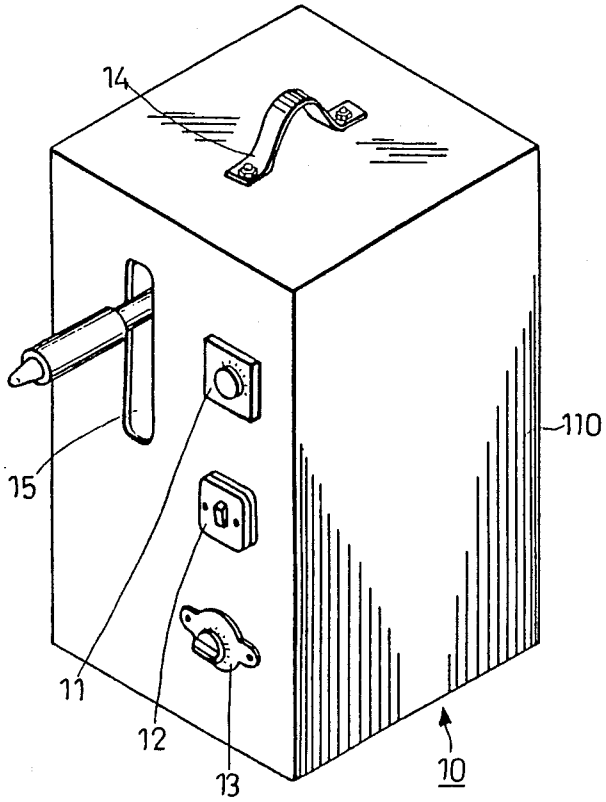
FIG. 1 is a three-dimensional view of a massage body structure preferably embodied in an electromechanical massage apparatus according to this invention.

In performing massage operations, a user first arranges a portion of his/her body or limb to be massaged on the detachable supporting mount 100 and keeps those portions in position through the help of binding straps 231 (if necessary), as shown in FIGS. 5 and 7, with the rest of his/her body being either confortably laid flat or sat upright on the supporting mount 100, the massage body structure 10 then being positioned close to the supporting mount 100 with the front end 801 of the massage member 80 in touch with the body area to be massaged (it is to be noted that before starting the massage operatin, some lubricating ointment is normally applied on the front end 801 of the massage member 80). By turning on the switch 12 (as shown in FIG. 1), the massage operation will begin. The moving speed of the massage member 80 can be adjusted by turning the speed regulator 11, and the time duration for massage operation can be set by the timer 13 according to a user's requirement. If during the massage operation, the moving distance of the massage member 80 is found to be too long, it can be easily adjusted by re-locating the lower end of the revolving rod 40 in a pin hole nearer to the center point of the swivel disk 30 (as shown in FIGS. 2 and 3). On the other hand, if a larger moving distance of the massage member 80 is required, the lower end of the revolving rod 40 can be re-located in a pin hole further away from the center point of the swivel disk 30. In addition, in order to keep the massage body structure 10 in a firm position, it can be placed either vertically or horizontally against a wall surface or other stationary object for obtaining satisfactory massage operations.

While preferred embodiments have been illustrated and described, it is apparent that many changes and modifications may be made in the gneral construction and arrangement of the invention without departing from the spirit and scope thereof, and it is therefore desired that the invention be not limited to the exact disclosure but only to the extent of the appending claims.

What is claimed is:

1. An electromechanical massage apparatus comprising:

a massage body structure with a housing unit adapted for being positioned either vertically or horizontally on a flat surface, having an elongated slot formed in a front side, and a handle ring attached on a top side, wherein the front side is provided with a speed regulating means for speed regulating operations, a switch for power supply control of the massage apparatus and a timer means for setting operational duration;

a driving means installed in said housing unit and electrically coupled with said speed regulating means, said switch and said timer means, for being operated at different speeds and time durations;

a swivel disk having a plurality of pin holes formed in a surface and separately located away from a center point thereof mounted on a shaft of said driving means for being driven to rotate at various speeds along with said driving means;

a linking mechanism composed of a revolving rod and a driven rod pivotally coupled together at one end, said driven rod being movably held in a spindle sleeve fixed on said housing unit and said revolving rod having its lower end movably connected to said swivel disk through one of said pin holes for being driven to move up and down at various speeds along with said swivel disk;

a push pole mechanism having its rear end movably arranged on a wall surface of the back side in the housing unit, its middle portion fixedly connected to an upper end of said linking mechanism, and its front end freely extending out of said elongated slot of the housing unit;

a massage means detachably installed around said front end of said push pole mechanism for being operated to perform massage upon a portion of the human body in touch with said massage means; and a detachable supporting means provided in conjunction with said housing unit for being used to support a portion of the human body positioned in conjunction with the location of said housing unit for the purpose of performing massage operations.

2. The massage apparatus according to claim 1 wherein said detachable supporting means comprises:

a base stand adapted for being positioned on a ground surface;

a mounting shaft adjustably matched with a shaft sleeve through a plurality of screw bolts vertically fixed on a middle portion of said base stand for providing support therewith;

a supporting plate fixed around said shaft sleeve for being adjusted up and down along with said shaft sleeve through said screw bolts;

a plurality of partitioning boards vertically installed on said supporting plate, defining different angled spaces therein;

a plurality of binding straps attached at different places on said partitioning boards for binding a certain part of a user's limb during massage;

an inverse L-shaped frame with a plurality of binding straps vertically fixed against one of said partitioning boards for defining an open section thereat so as to allow a user's limb to pass through; and an oblique plate having a pair of notches formed at one side thereof secured at an upper portion of said L-shaped frame so as to form a slant face thereat for being used to keep a user's foot in position during massage; thereby, with said massage body structure being positioned adjacent of said detachable supporting means a user's body portion can be rested on said supporting means for the performing of massage operations.

3. The massage apparatus according to claim 1 wherein said massage means comprises:

a cylindrical body portion having a front end and a resilient means, said cylindrical body portion enclosing said front end of said push pole mechanism and detachably secured thereto for performing massage operations along with the movement of said push pole mechanism.

4. The massage apparatus according to claim 1 wherein said massage means comprises:

a cylindrical body portion having a front end for retaining contact with a portion of a human body and a sliding slot formed though opposing sides of the cylindrical body portion, said cylindrical body portion is movably attached to said front end of said push pole mechanism, said sliding slot slidingly held by a stop pin which is fixed at said front end of said push pole mechanism; and a pair of resilient elements whose rear ends are symmetrically fixed on a rear end of the cylindrical body portion and whose front ends are separately fastened on an inner wall of the front side of said housing unit.

5. The massage apparatus accordingly to claim 1 wherein said massage means comprises a double-arm structure with a body portion and a resilient element for being detachably mounted on said front end of said push pole mechanism.

6. The massage apparatus according to claim 1 wherein said massage means comprise a bow-type body structure with a cross brace on one side thereof for being detachably mounted on said front end of said push pole mechanism, and a massage member disposed at a middle portion of said cross brace for performing massage operations suitable for various portions of a human body.

* * * * *